US011396411B2

(12) United States Patent
Britton et al.

(10) Patent No.: US 11,396,411 B2
(45) Date of Patent: Jul. 26, 2022

(54) CHILD RESISTANT PAPERBOARD BOX

(71) Applicant: CDI Printing Services, Inc., Gibsonia, PA (US)

(72) Inventors: Blayre I. Britton, Gibsonia, PA (US); Joy G. Shelley, Blawnox, PA (US)

(73) Assignee: CDI Printing Services, Inc., Gibsonia, PA (US)

( * ) Notice: Subject to any disclaimer, the term of this patent is extended or adjusted under 35 U.S.C. 154(b) by 0 days.

(21) Appl. No.: 17/115,066

(22) Filed: Dec. 8, 2020

(65) Prior Publication Data

US 2022/0063882 A1 Mar. 3, 2022

Related U.S. Application Data

(60) Provisional application No. 63/073,275, filed on Sep. 1, 2020.

(51) Int. Cl.

| | |
|---|---|
| ***B65D 5/38*** | (2006.01) |
| ***B65D 55/02*** | (2006.01) |
| ***B65D 50/06*** | (2006.01) |

(52) U.S. Cl.

CPC ..... *B65D 55/02* (2013.01); *B65D 5/38* (2013.01); *B65D 50/066* (2013.01); *B65D 2215/04* (2013.01); *B65D 2255/20* (2013.01)

(58) Field of Classification Search

CPC ..... B65D 5/38; B65D 5/42; B65D 83/0463; B65D 83/04; B65D 2215/02; B65D 2215/04; B65D 75/327

USPC ..... 206/1.5, 531, 539; 229/125.125

See application file for complete search history.

(56) References Cited

U.S. PATENT DOCUMENTS

| | | | | |
|---|---|---|---|---|
| 2,358,502 | A | 9/1944 | Gilbert | |
| 2,999,758 | A * | 9/1961 | Brown | B65D 81/24 229/87.08 |
| 3,419,459 | A * | 12/1968 | Haren | B65D 65/406 229/199 |
| 4,189,087 | A | 2/1980 | Dlugopolski | |
| 4,401,210 | A | 8/1983 | Anjou | |
| 4,524,900 | A | 6/1985 | Salminen | |
| 6,641,031 | B2 | 11/2003 | Evans et al. | |
| 6,976,576 | B2 | 12/2005 | Intini | |
| 7,389,875 | B2 | 6/2008 | Sandberg et al. | |
| 7,708,145 | B2 | 5/2010 | Li et al. | |
| 7,845,496 | B2 * | 12/2010 | Hession | B65D 83/0463 229/125.125 |
| 7,854,325 | B2 | 12/2010 | Bentele | |
| 7,866,466 | B2 | 1/2011 | Rose et al. | |
| 8,225,931 | B2 | 7/2012 | Wharton | |

(Continued)

*Primary Examiner* — King M Chu

(74) *Attorney, Agent, or Firm* — Cozen O'Connor

(57) ABSTRACT

A paperboard box configured in a child-resistant manner includes a paperboard tray, and includes a paperboard over-sleeve that is closed at one end and open at the opposite end, where the paperboard tray is housed within the paperboard over-sleeve, the paperboard tray and the paperboard over-sleeve are locked together by interlocking tabs and where one tab is located on the inside of the paperboard over-sleeve and another tab is located on the outside of the paperboard tray, whereby these two interlocking tabs engage with each other and prevent the paperboard box from being opened through normal force when attempting to slide the paperboard tray out from the end of the paperboard over-sleeve.

12 Claims, 16 Drawing Sheets

(56) References Cited

U.S. PATENT DOCUMENTS

| | | | |
|---|---|---|---|
| 8,235,204 | B2 | 8/2012 | Loughman et al. |
| 8,499,929 | B2 | 8/2013 | Chatelain |
| 8,584,843 | B2 | 11/2013 | Hillard |
| 8,899,414 | B2 | 12/2014 | Chatelain et al. |
| 9,926,125 | B2 | 3/2018 | Whitehurst |
| 9,981,788 | B2 | 5/2018 | Skinner |
| 10,450,101 | B2 | 10/2019 | Bressan et al. |
| 10,479,581 | B2 | 11/2019 | Chambers et al. |
| 10,518,927 | B2 | 12/2019 | Chambers |
| 10,618,683 | B2 | 4/2020 | Jones |
| 10,696,443 | B1 | 6/2020 | Mundt et al. |
| 10,710,785 | B2 | 7/2020 | Patwardhan |
| 2007/0054525 | A1 | 3/2007 | Jones et al. |
| 2007/0251983 | A1 | 11/2007 | Freeze |
| 2018/0022498 | A1 | 1/2018 | Everett |
| 2019/0375537 | A1 | 12/2019 | Nakovski |
| 2020/0039717 | A1 | 2/2020 | Chambers et al. |
| 2020/0189813 | A1 | 6/2020 | Drosos et al. |

* cited by examiner

CHILD RESISTANT PAPERBOARD BOX

CROSS-REFERENCE TO RELATED APPLICATIONS

This application claims priority from U.S. Provisional Application Ser. No. 63/073,275 filed Sep. 1, 2020, the content of which is incorporated herein by reference in its entirety.

BACKGROUND OF THE INVENTION

1. Field of the Invention

The present invention relates to packaging and, more particularly, to a child resistant paperboard box.

2. Description of the Related Art

Cartons or other paperboard containers may be used for holding and storing small items. In some implementations, the items held or stored in the containers may be harmful to certain users, such as children (e.g., a pharmaceutical drug). A user may desire to hold or store items in a lockable, child-resistant container.

Child-proof containers, i.e., containers that at least small children cannot open are desirable for a plurality of goods, which could be harmful to the children and/or to the surroundings. Such goods can be, e.g., medical pills, matches or needles.

For such purposes, well-functioning child-proof containers have been more or less developed. In most cases, these containers are formed with ledge-shaped locking members projecting from the flat side surface of the casing. These conventional locking members, however, have generally only a very modest locking ability, which can often be overcome without large or extreme forces, by merely pushing the box in its normal direction of opening, and this can often also be accomplished by small children.

U.S. Pat. No. 4,401,210 to Anjou discloses one such child-proof container consisting of a casing and a box displaceably arranged therein, whereby the side walls of the casing at the interior are provided with locking members located diagonally to each other and intended to cooperate with recesses in the side walls of the box, whereby the locking members are arranged to be able to be moved away from locking position in the recesses via external forces, which can be applied with two fingers diagonally on the casing to give this a rhomboidic shape, whereby at the same time a pressure force exerted by a third finger can push the box out of the container.

U.S. Pat. No. 6,641,031 to Evans et al. discloses a method and another child resistant carton assembly that includes a carton having a body panel. A locking panel is spaced apart from the body panel. The locking panel and the body panel define a locking chamber. A tray is slidably mounted in the carton. The tray includes a locking tab adapted to releasably engage the locking panel such that at least an insert portion of the locking tab is disposed in the locking chamber.

U.S. Pat. No. 6,976,576 to Intini discloses a child-resistant/senior friendly dispensing package comprising a dispensing member having a dispensing cavity and a product storage cavity, where the dispensing member is mounted within a sleeve that is movable from a first stored position to a second position, and where the dispensing cavity is external to the housing to permit dispensing of the product. The dispensing package also includes a device having first and second locks that must be operated either sequentially or simultaneously in order to move the dispensing cavity exteriorly of the housing, where the device preferably permits the dispensing of only a single tablet or product.

There is a need for a child-proof container, which functions well to safely prohibit opening by a person who unfamiliar with the opening method and which, at the same time, does not require high forces to correctly open the container.

SUMMARY OF THE INVENTION

Disclosed is a paperboard box, which is configured in a child-resistant manner. The paperboard box includes a paperboard tray and a paperboard over-sleeve that is closed at one end and open at the opposite end. The paperboard tray is housed within the paperboard over-sleeve. The paperboard tray and the paperboard over-sleeve are locked together by interlocking tabs, where one tab is located on the inside of the paperboard over-sleeve and another tab is located on the outside of the paperboard tray. These two tabs engage with each other and prevent the paperboard box from being opened through normal force when attempting to slide the paperboard tray out from the bottom of the paperboard over-sleeve.

In order to open the paperboard box and access products located within the paperboard tray, (i) a sleeve divider tab located within the inside of the tray must be pushed or folded downward, (ii) the tray must be slid to the opposite side of the paperboard over-sleeve—beyond the now folded tab of the paperboard over-sleeve, and (iii) the paperboard tray is then unlocked to permit its removal by pulling it out of the open end of the paperboard over-sleeve to a position that permits access to products within the paperboard tray.

In order to close the paperboard box, the paperboard tray must be slid back to the opposite side of the paperboard over-sleeve, and then pushed into the paperboard over-sleeve.

Other objects and features of the present invention will become apparent from the following detailed description considered in conjunction with the accompanying drawings. It is to be understood, however, that the drawings are designed solely for purposes of illustration and not as a definition of the limits of the invention. It should be further understood that the drawings are not necessarily drawn to scale and that, unless otherwise indicated, they are merely intended to conceptually illustrate the structures and procedures described herein.

BRIEF DESCRIPTION OF THE DRAWINGS

An exemplary embodiment of the invention is explained in greater detail below with reference to the drawings, this comprising schematic and greatly simplified figures in which.

DETAILED DESCRIPTION OF THE EXEMPLARY EMBODIMENTS

Figure 1:
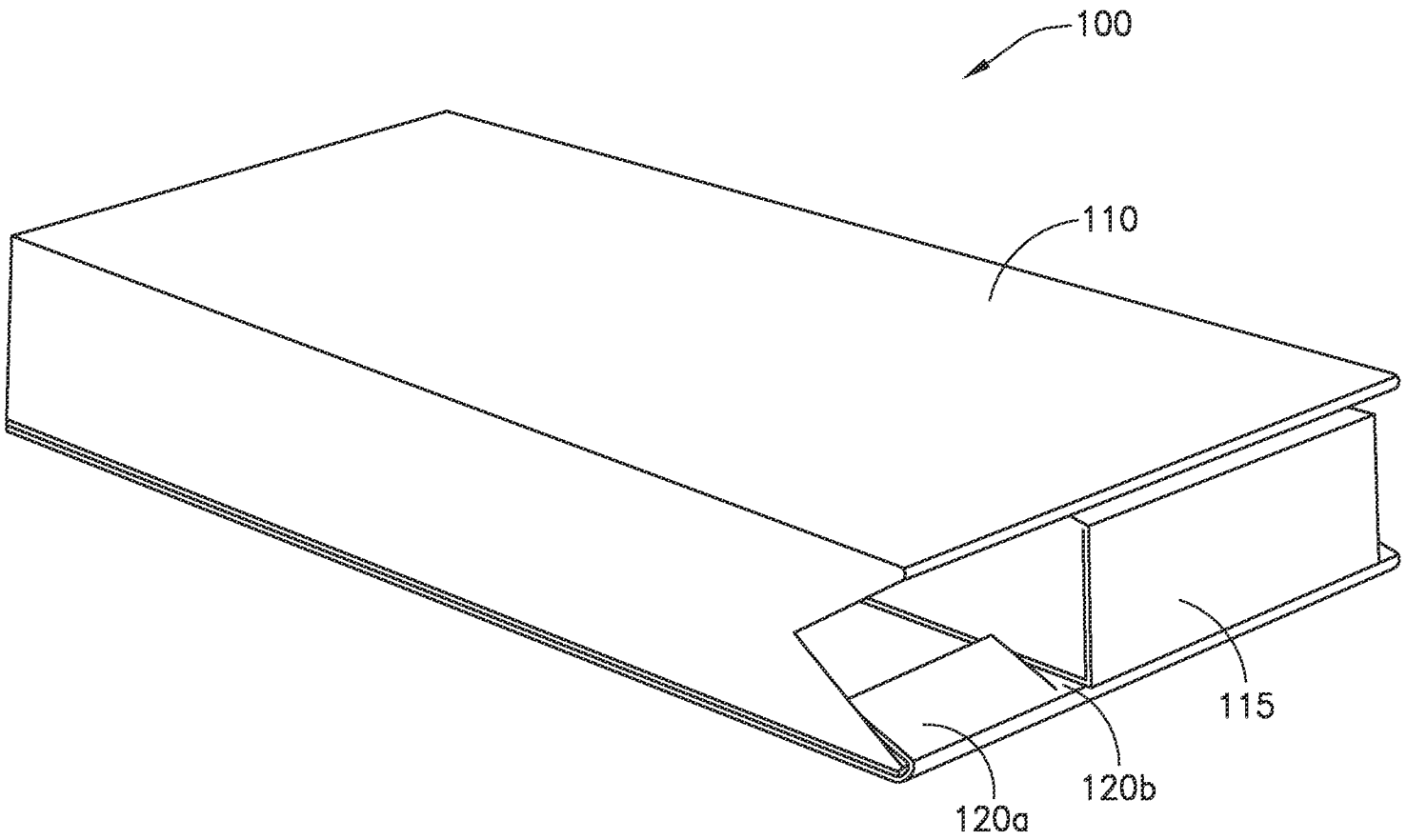
FIG. 1 is an illustration of the paperboard box in accordance with the invention.

FIG. 1 is an illustration of the paperboard box 100 that is configured in a child-resistant manner. With reference to FIG. 1, the paperboard box 100 is formed from a paperboard over-sleeve 110 and a paperboard tray 115 that is lockingly inserted within the paperboard over-sleeve 110 to create a locked storage compartment.

The paperboard box 100 is constructed from a material, such as cardboard, which provides resistive properties, while at the same time is thin enough to be folded into the final form of the paperboard box 100. The paperboard box 100 is manufactured from 18 point to 22 point, preferably 20 point, board grade paper, which is a grade of paper made for packaging, as opposed to finished grade paper. The paper grade has been found to be a critical aspect of the invention and thus it has been found that the grade of 20 points provides the optimal level of resilience to provide required resistive or properties associated with resilience. The paperboard over-sleeve 110 and paperboard tray 115 are folded into mutually engaging rectangular forms, where the final assembly is held in shape via a suitable glue, in a manner known to the skilled person. In order to provide resistance to merely tearing the paperboard box 100 apart to gain entry, the box is provided with a plastic laminate layer. In this way, a child cannot simply tear the box apart without resorting to more destructive methodologies, such as cutting the box with scissors.

As shown in FIG. 1, the paperboard over-sleeve 110 includes a flap that includes first and second sleeve tabs 120*a*, 120*b*, where the first sleeve tab 120*a* is resiliently biased in a manner that resists transverse or lateral movement of the paperboard tray 115 when the paperboard tray 115 is in the closed position, as depicted in FIG. 1. The second sleeve tab 120*b* engages with a first tray tab 135 of the paperboard tray 115 (see FIG. 3) in a locking manner when the paperboard tray 115 is pulled along the longitudinal axis of the paperboard box 100 to an open position.

Figure 2:
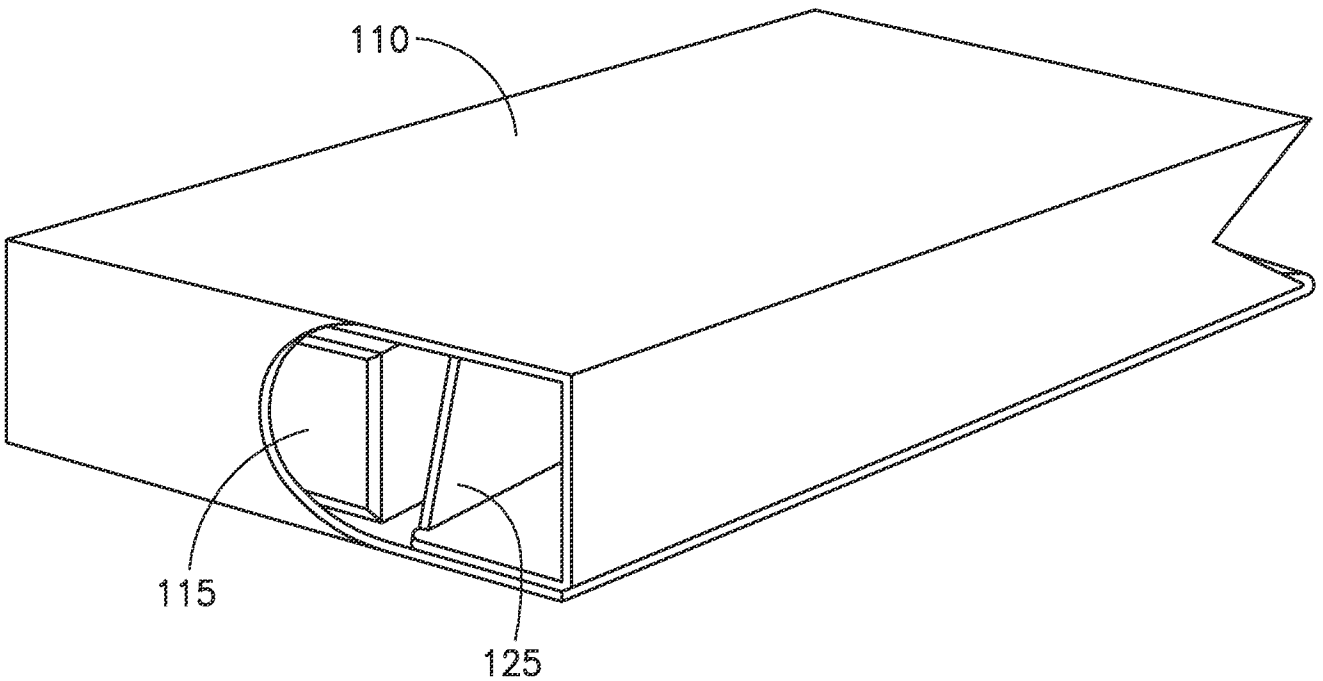
FIG. 2 is an illustration of an end view of the paperboard box in accordance with the invention.

FIG. 2 shows an end view of the paperboard box 100 in accordance with the invention. Here, a sleeve divider tab 125 is shown arranged adjacent to the paperboard tray 115. The sleeve divider tab 125 extends along the interior of the paperboard tray 115 and creates a channel within which the paperboard tray 115 is locked in place by the sleeve divider tab 125. The sleeve divider tab 125 is circumferentially rotatable about an axis that extends lengthwise or longitudinally of the paperboard box 100 to permit transverse or lateral movement of the paperboard tray 115 when seeking to open the paperboard tray 115 to gain access to product stored within the paperboard tray 115.

Figure 3:
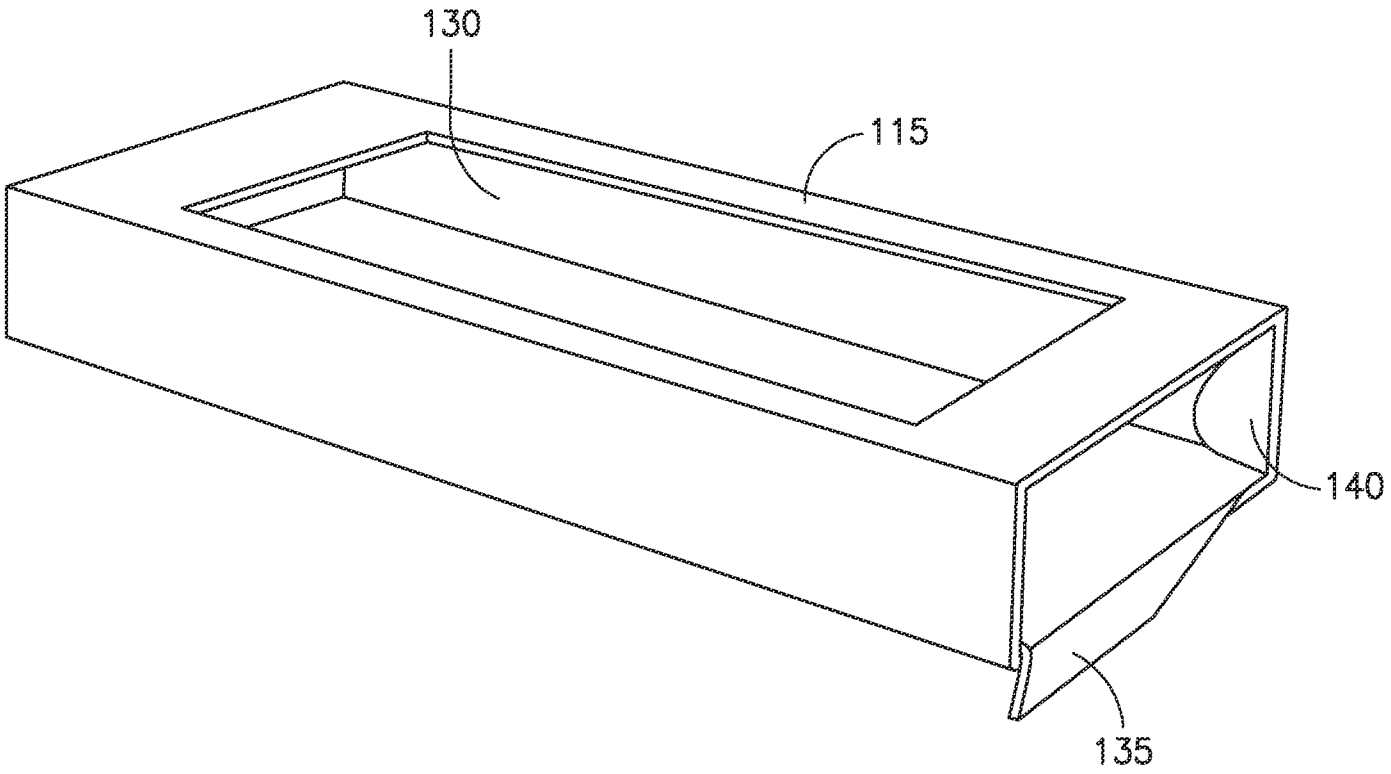
FIG. 3 is an illustration of the paperboard tray in accordance with an embodiment of the invention.

FIG. 3 is an illustration of the paperboard tray 115 in accordance with an embodiment of the invention. With reference to FIG. 3, the paperboard tray 115 is formed in the shape of a rectangle and includes an upper opening 130, a first tray tab 135 and a second tray tab 140, where the first tray tab 135 engages in a locking manner with the second sleeve tab 120*b* of the paperboard tray 115 (see FIG. 1) when the paperboard tray 115 is pulled along the longitudinal axis of the paperboard box 100 to the open position.

Figure 4:
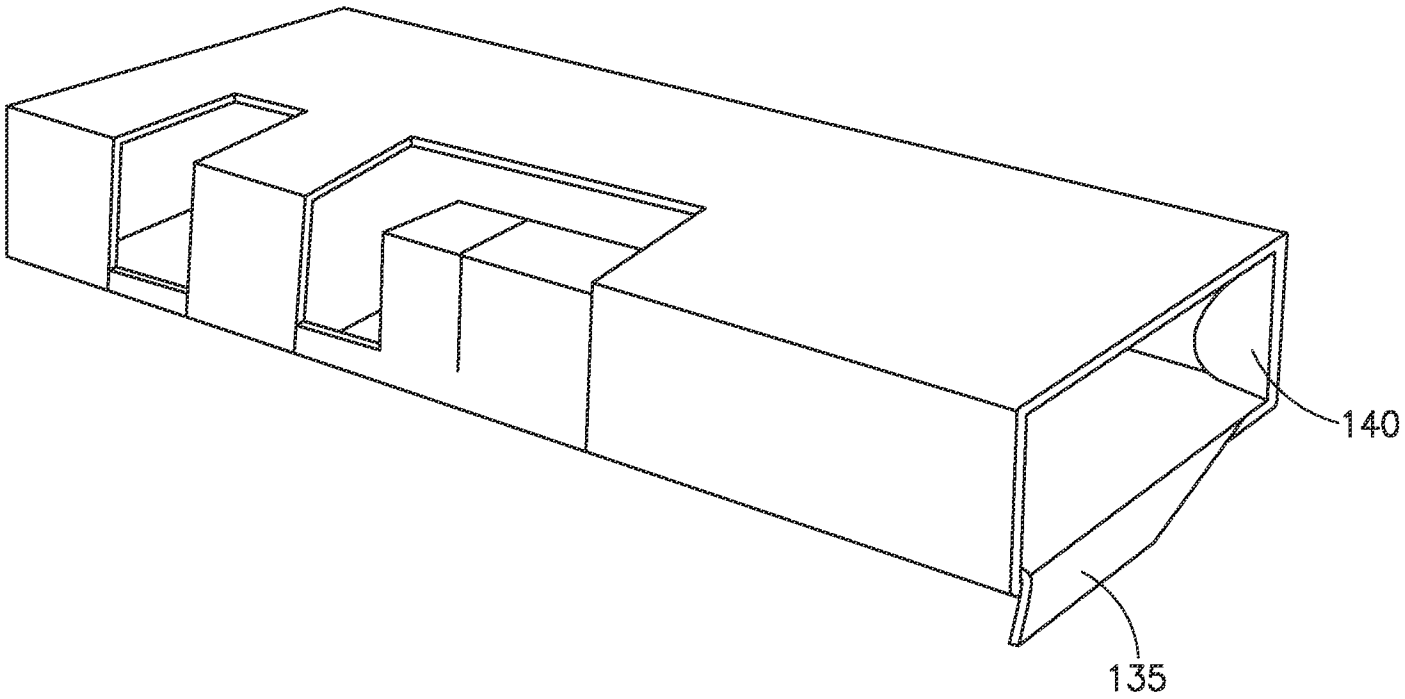
FIG. 4 is an illustration of the paperboard tray in accordance with a preferred embodiment of the invention.

FIG. 4 is an illustration of the paperboard tray 115 in accordance with a preferred embodiment of the invention. In the preferred embodiment, the paperboard tray 115 has closed upper and lower surfaces, where an opening is provided at one end that includes a first tray tab 135 and a second tray tab 140, where the first tray tab 135 engages in a locking manner with the second sleeve tab 120*b* of the paperboard tray 115 (see FIG. 1) when the paperboard tray 115 is pulled along the longitudinal axis of the paperboard box 100 to the open position. As opposed to providing the upper opening 130 of the prior described embodiment, the presently contemplated preferred embodiment includes cutouts 145*a*, 145*b*, in this way, the paperboard tray 115 of the preferred embodiment is easier to manufacture and more flexible in the types of product that can be housed in the paperboard box 100 without adding an additional piece or insert.

Figure 5:
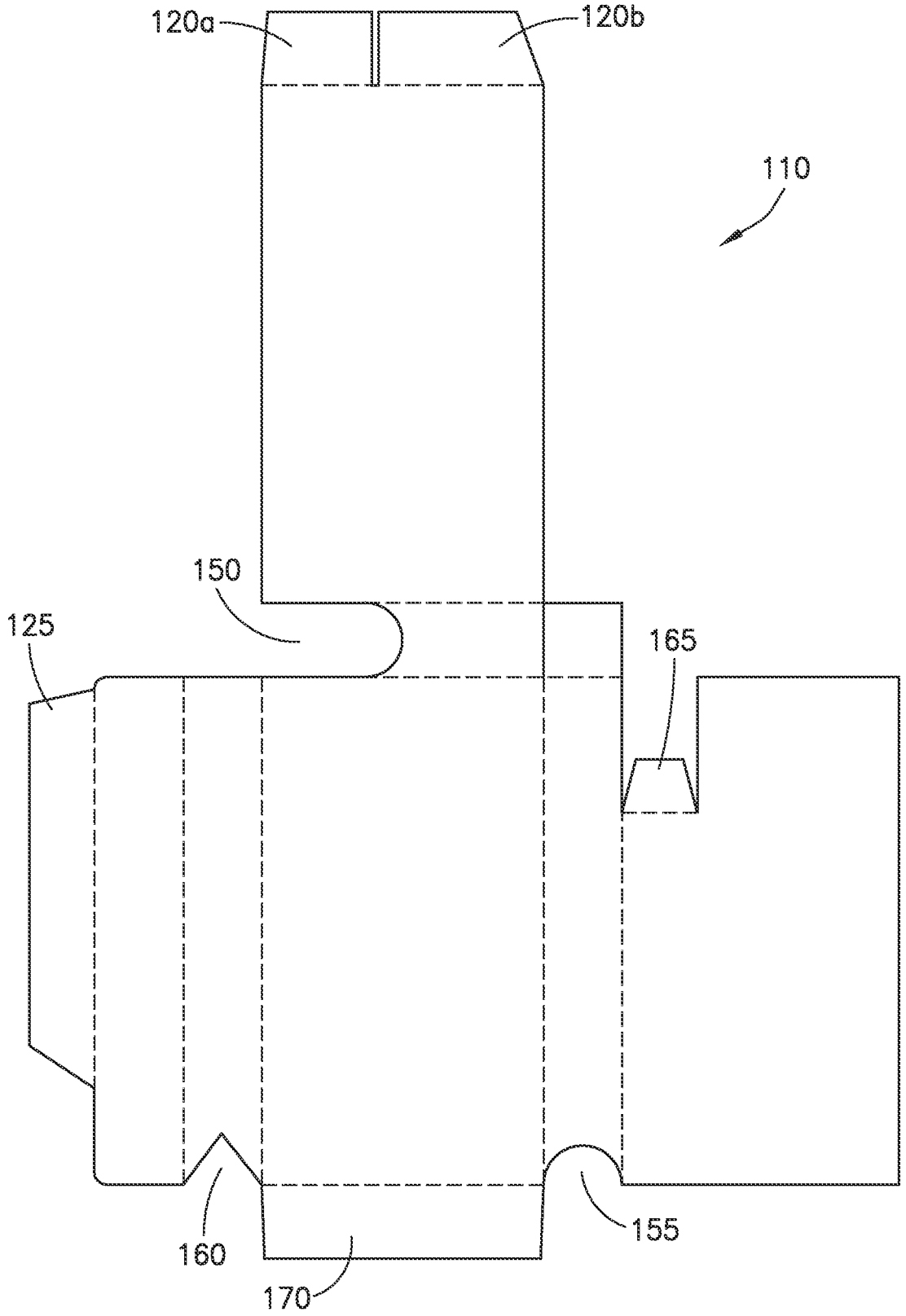
FIG. 5 is a plan view illustration of the paperboard over-sleeve in an unfolded state in accordance with the invention.

FIG. 5 is a plan view illustration of the paperboard over-sleeve 110 in an unfolded state in accordance with the invention. As depicted in FIG. 5, the paperboard over-sleeve 110 has a flap that includes the first and second sleeve tabs 120*a*, 120*b*, the divider tab 125, first and second u-shaped cutouts 150, 155, a triangular shaped cutout 160, an internal sleeve locking tab 165 and an upper sleeve tab 170. In assembled form, the first sleeve tab 120*a* is resiliently biased in a manner that resists transverse or lateral movement of the paperboard tray 115 when the paperboard tray 115 is in the closed position depicted in FIG. 1. The second sleeve tab 120*b* engages, in a locking manner, with a first tray tab 135 of the paperboard tray 115 (see Fla 3) when the paperboard tray 115 is pulled along the longitudinal axis of the paperboard box 100 to an open position to prevent complete removal of the paperboard tray 115 from within the paperboard over-sleeve 110. The internal tray locking tab 165, on the other hand, engages with the first tray tab 135 of the paperboard tray 115 and prevents the paperboard box 100 from being opened through normal force when attempting to slide the paperboard tray 115 from within the paperboard over-sleeve 110 to reveal its contents. The first and second u-shaped cutouts 150, 155 are provided to permit access during removal of the paperboard tray 115.

Figure 6:
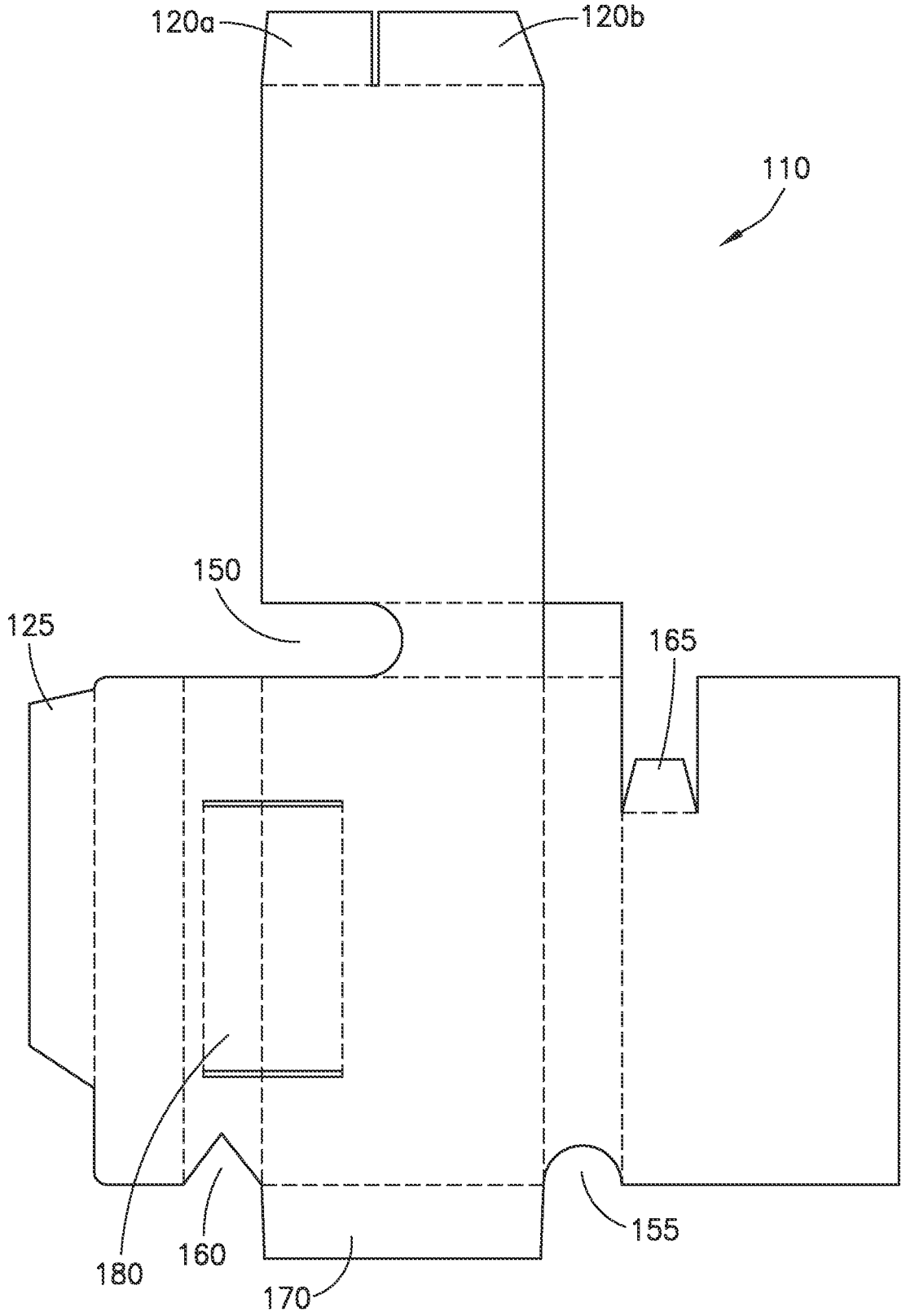
FIG. 6 is a plan view illustration of the paperboard over-sleeve in an unfolded state in accordance with an alternative preferred embodiment of invention.
Figure 7:
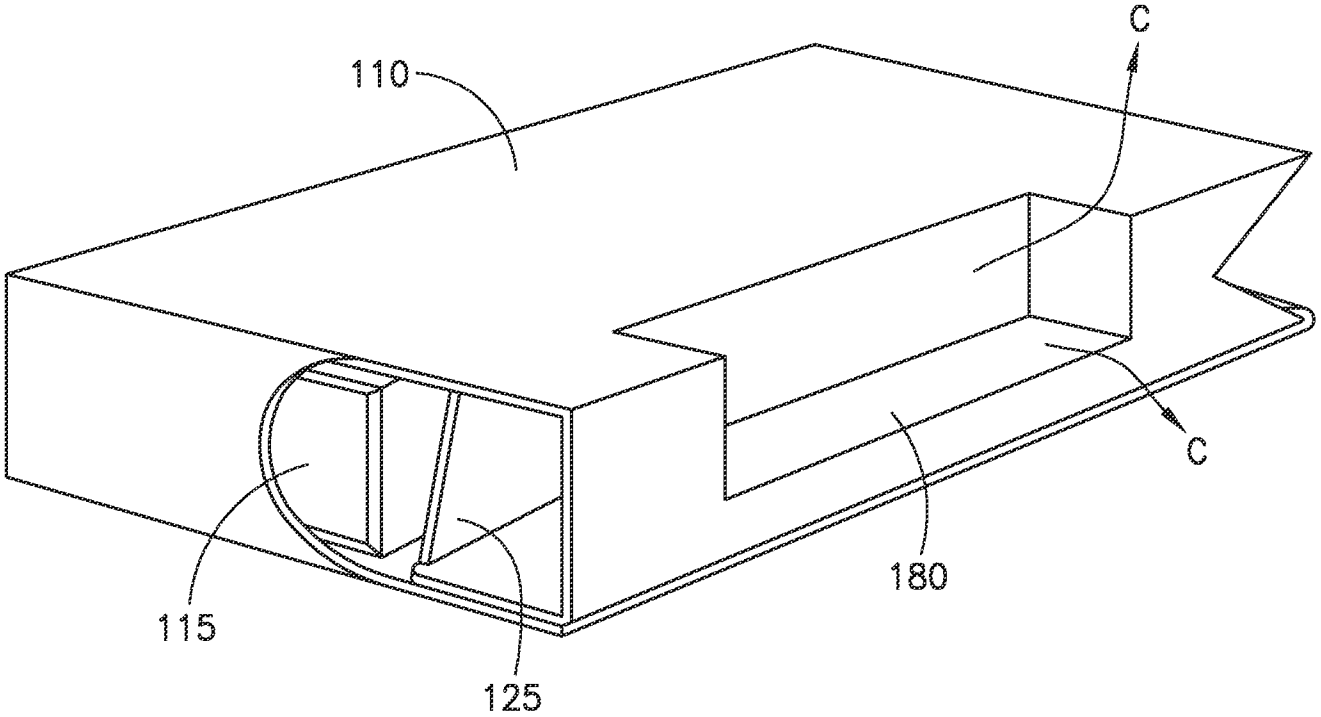
FIGS. 7, 8 and 9 are illustrations of the paperboard box in accordance with an alternative preferred embodiment of the invention.
Figure 8:
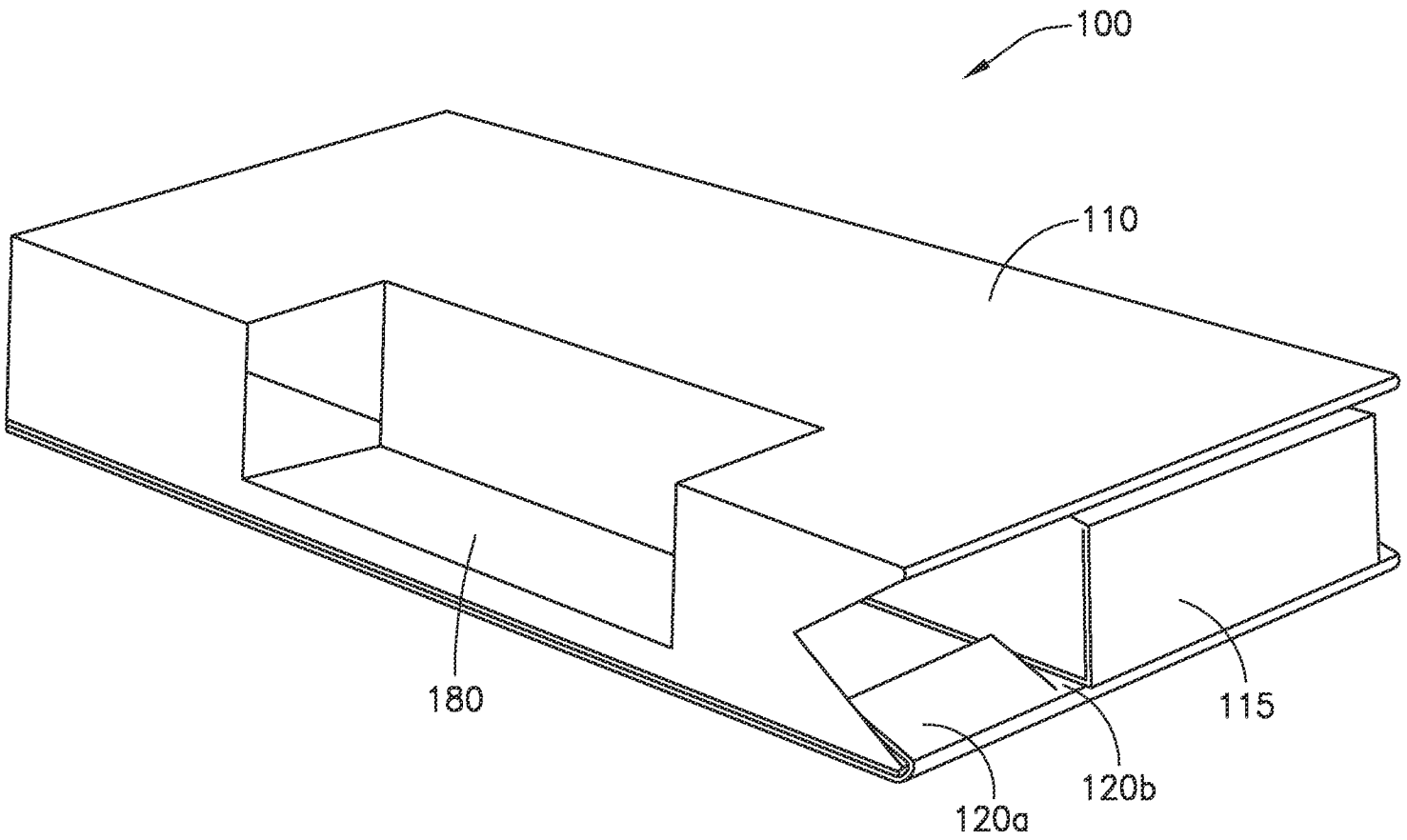
Figure 9:
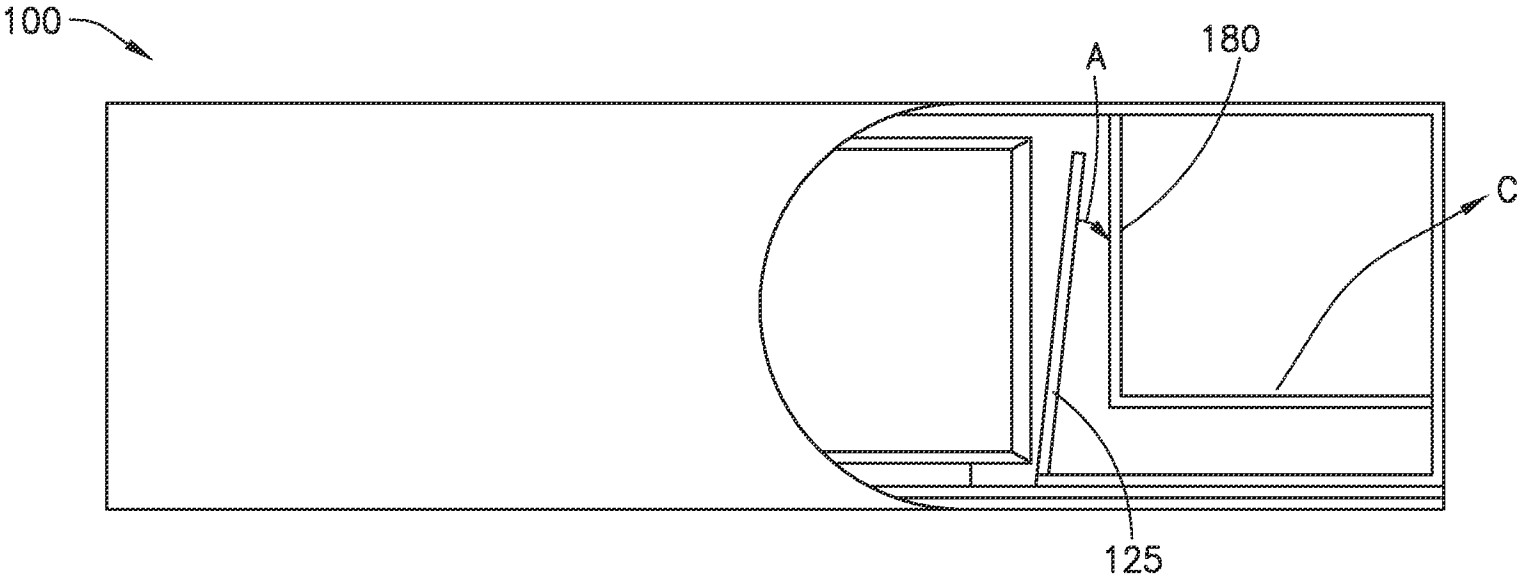

FIG. 6 is a plan view illustration of the paperboard over-sleeve 110 in an unfolded state in accordance with an alternative preferred embodiment of the invention. Here, the paperboard over-sleeve 110 is provided with a folding indentation section 180 that rests against the sleeve divider tab 125 when the paperboard tray 115 is locked in place by the sleeve divider tab 125 (see FIGS. 7 and 8). By providing the folding indentation section 180, the sleeve divider tab 125 requires a greater level of force to circumferentially rotate the sleeve divider tab 125 in the direction indicated by arrow A (see FIG. 9). When the required force is provided, e.g., when opening the paperboard box 100, the folding indentation section 180 moves into a final position in the direction indicated by arrow(s) C (see FIGS. 7 and 9), whereby the inner edge of the folding indentation section 180 moves to a position to form a planar edge with the upper edge of the paperboard over-sleeve 110.

Figure 10:
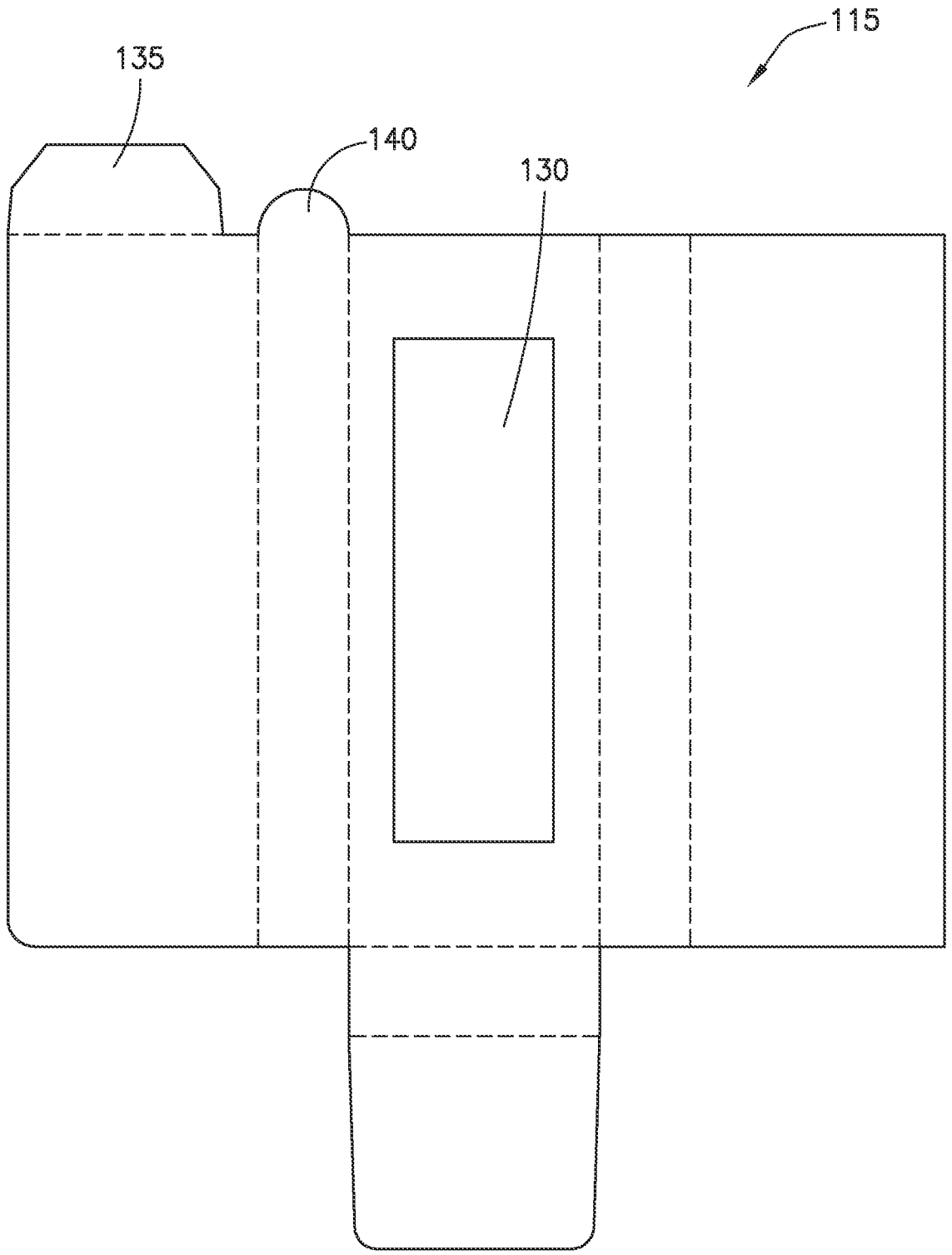
FIG. 10 is a plan view illustrating the paperboard tray of FIG. 3 in an unfolded state.

FIG. 10 is a plan view of the paperboard tray 115 in an unfolded state. As shown, the paperboard tray 115 includes an opening 130, a first tray tab 135 and a second tray tab 140, where the first tray tab 135 engages in a locking manner with the second sleeve tab 120*b* of the paperboard tray 115 (see FIG. 1) when the paperboard tray 115 is pulled along the longitudinal axis of the paperboard box 100 to the open position. The first tray tab 135 engages with the second sleeve tab 120*b* of the paperboard over-sleeve 115 (see FIG. 5) in a locking manner when the paperboard tray 115 is pulled along the longitudinal axis of the paperboard box 100 to an open position. The first tray tab 135 engages with the second sleeve tab 120*b* of the paperboard over-sleeve 110 and thus prevents the paperboard box 100 from being opened through normal force when attempting to slide the paperboard tray 115 out from the within the paperboard over-sleeve 110.

Figure 11:
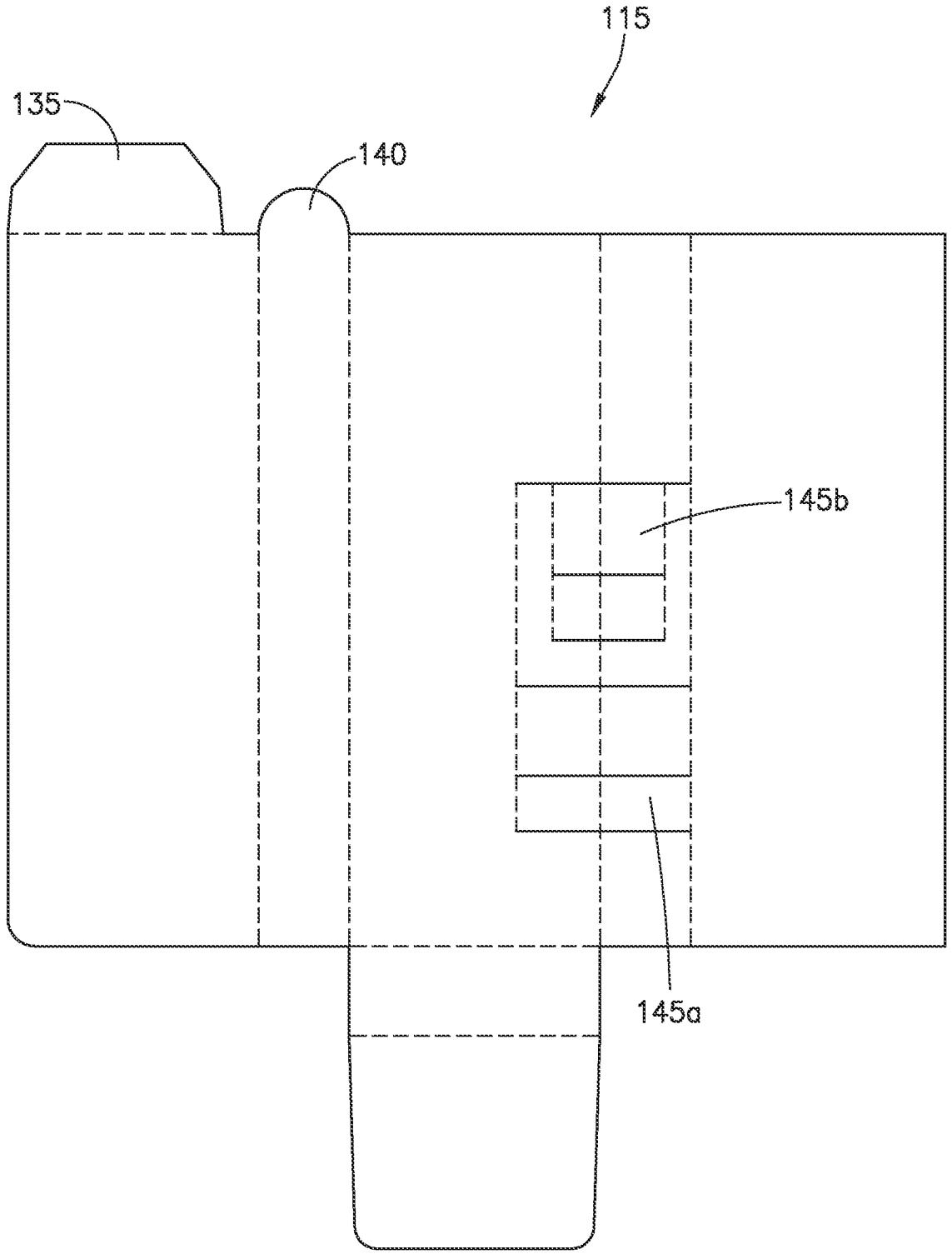
FIG. 11 is a plan view illustrating the paperboard tray of FIG. 4 in an unfolded state.

FIG. 11 is a plan view of the paperboard tray 115 in accordance with the preferred embodiment in an unfolded state. The paperboard tray 115 includes a first tray tab 135 and a second tray tab 140, where the first tray tab 135 engages in a locking manner with the second sleeve tab 120*b* of the paperboard tray 115 (see FIG. 1) when the paperboard tray 115 is pulled along the longitudinal axis of the paperboard box 100 to the open position. The paperboard tray 115 also includes cutouts 145*a*, 145*b* such that the paperboard tray 115 is easier to manufacture and more flexible in the types of product that can be housed in the paperboard box 100 without adding an additional piece or insert.

Figure 12:
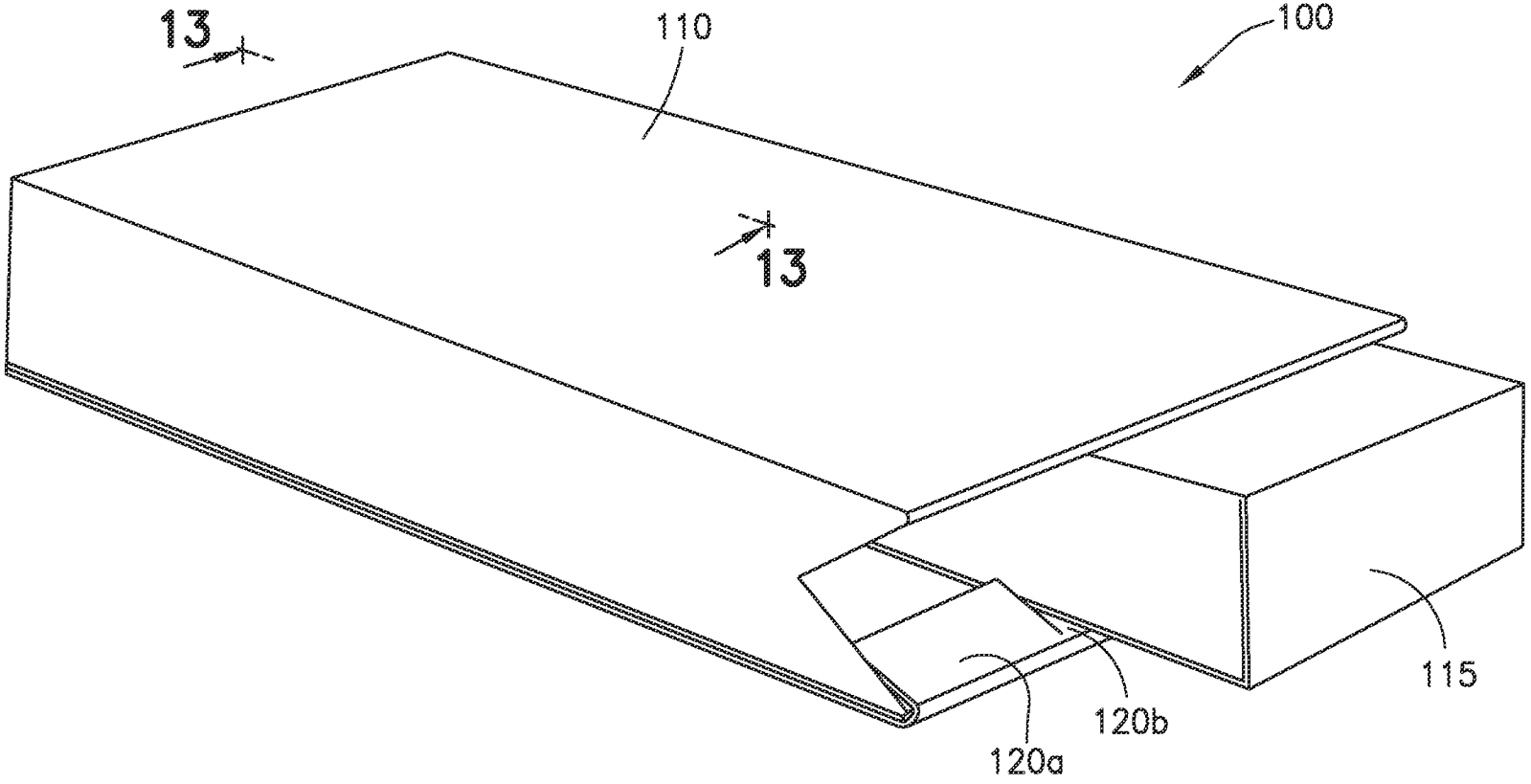
FIG. 12 is an illustration of the paperboard box in a partially opened state in accordance with the invention.
Figure 13:
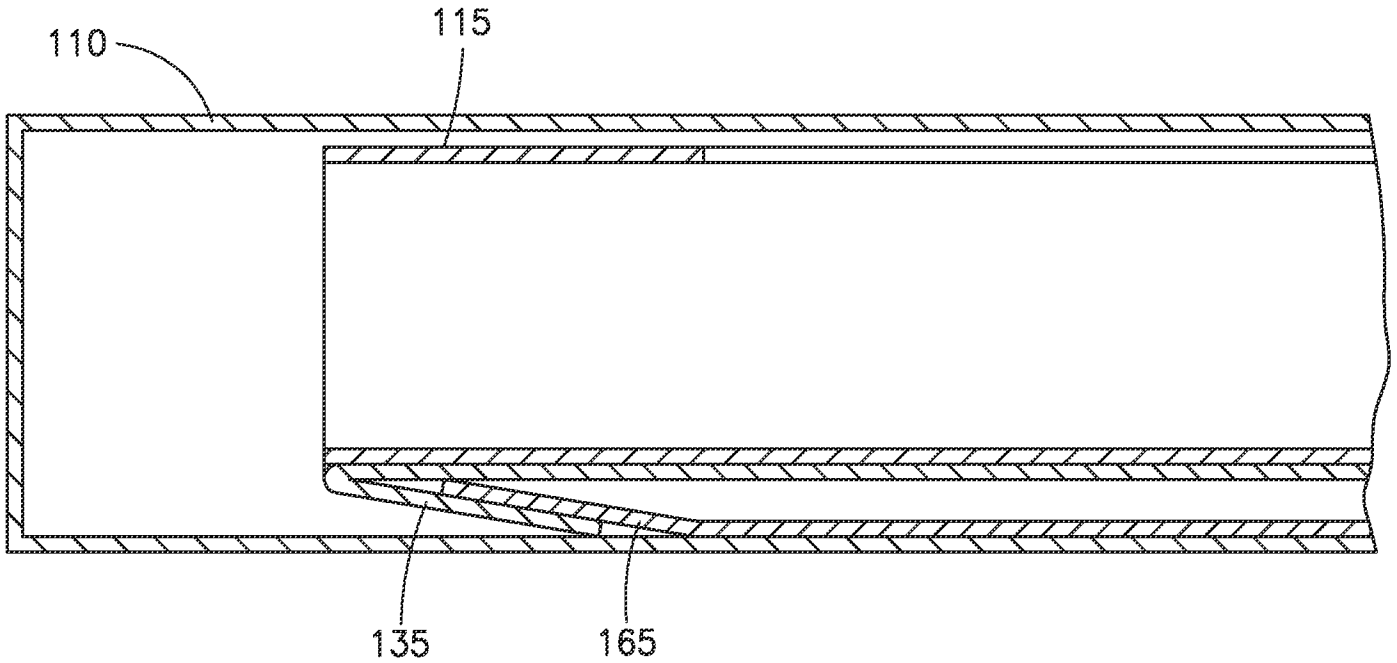
FIG. 13 is a cross-sectional illustration along 9-9 of the paperboard box of FIG. 8 in a restricted state.

FIG. 12 shows the paperboard box 100 in a partially opened state. Here, the internal tray locking tab 165 has engaged with the first tray tab 135 of the paperboard tray 115 such that the paperboard tray 115 cannot extend tram the paperboard box 100 through normal force to reveal its content. The locking engagement of the internal tray locking tab 165 with the first tray tab 135 is shown in FIG. 13, which is a cross-sectional illustration along 9-9 of the paperboard box 100 in the partially opened state.

Figure 14:
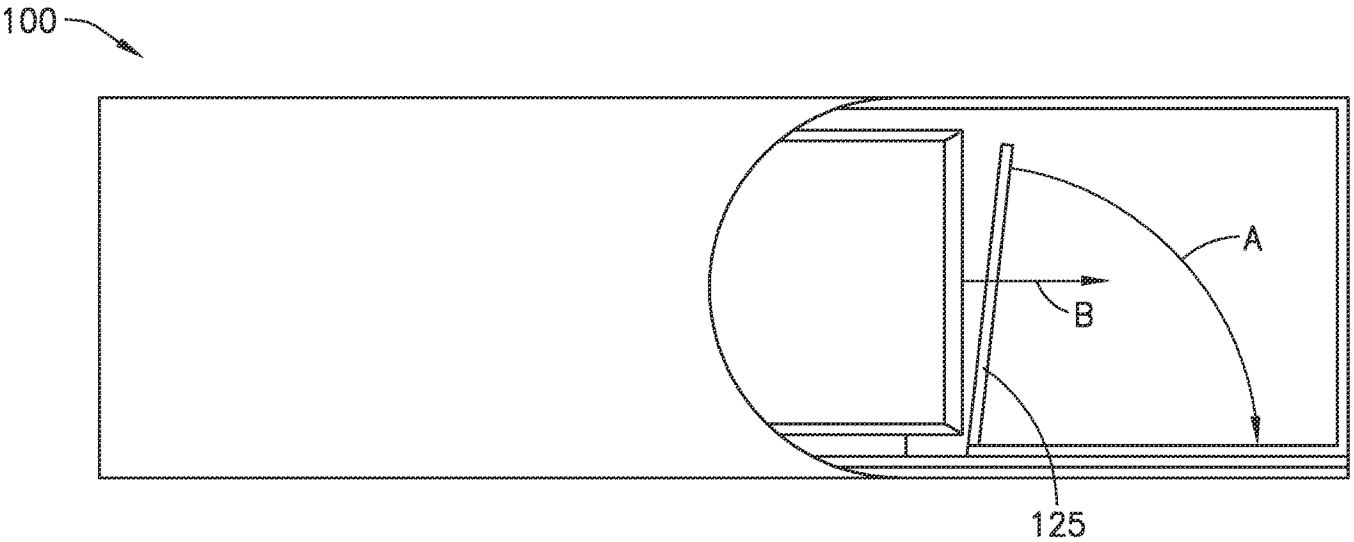
FIG. 14 is an illustration of another end view of the paperboard box with the paperboard tray in a locked and inserted state in accordance with the invention.

FIG. 14 shows an end view of the paperboard box 100 with the paperboard tray 115 in a locked and inserted state in accordance with the invention. The sleeve divider tab 125 is shown arranged adjacent to the paperboard tray 115. The sleeve divider tab 125 extends along the interior of the paperboard tray 115 and creates a channel within which the paperboard tray 115 is locked in place by the sleeve divider tab 125. The sleeve divider tab 125 is circumferentially rotatable about an axis, in a direction indicated by arrow A, which extends lengthwise or longitudinally of the paperboard box 100 to permit transverse or lateral movement, indicated by arrow B, of the paperboard tray 115 when seeking to open the paperboard tray 115 to gain access to product stored within the paperboard tray 115.

Figure 15:
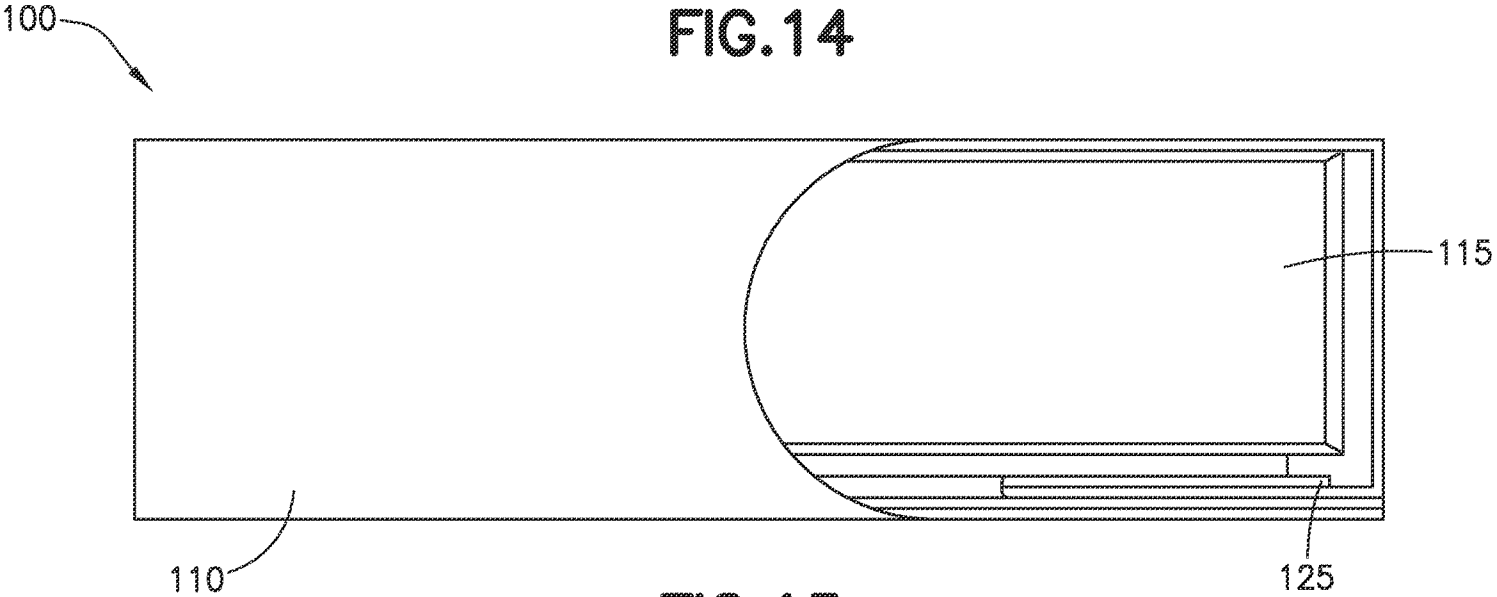
FIG. 15 is an illustration of another end of the paperboard with the paperboard tray at an unlocked and inserted state in accordance with the invention.

FIG. 15 shows the end of the paperboard box 100 with the paperboard tray 115 at an unlocked and inserted state in accordance with the invention. Here, the sleeve divider tab 125 has been rotated and the paperboard tray 115 has been moved transversely or laterally, in the directions indicated by arrows A and B shown in FIG. 14, such that it is now possible to slide the paperboard tray 115 lengthwise or along the longitudinal axis of the paperboard box 100 to gain access to product stored within the paperboard tray 115. In this state, the second sleeve tab 120*b* engages with the first tray tab 135 of the paperboard tray 115 (see FIG. 3) in a locking manner to prevent complete removal of the paperboard tray 115 from within the paperboard over-sleeve 110.

Figure 16:
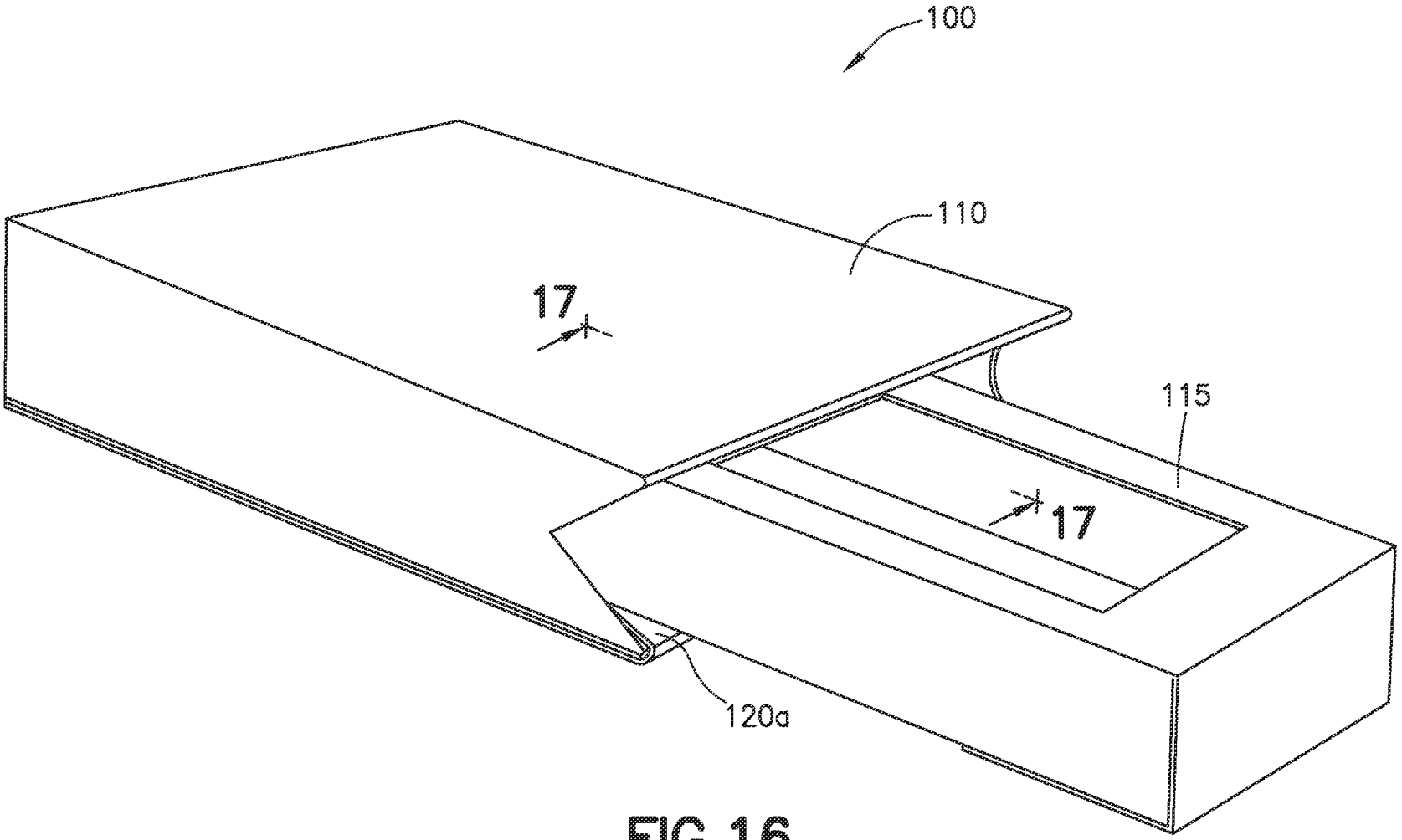
FIG. 16 is an illustration of the paperboard in an opened state in accordance with the invention.
Figure 17:
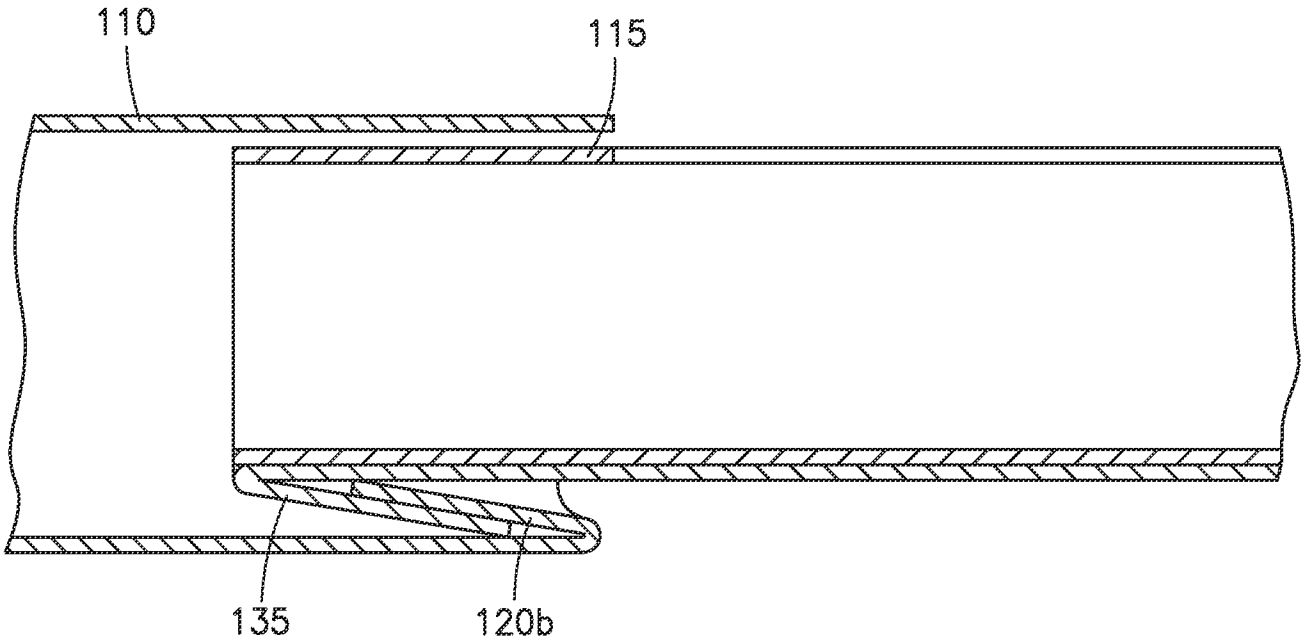
FIG. 17 is a cross-sectional illustration along 13-13 of the paperboard box of FIG. 12 in an opened state in accordance with the invention.

FIG. 16 shows the paperboard box 100 in an opened state. Here, the second sleeve tab 120*b* has engaged with the first tray tab 135 of the paperboard tray 115 (see FIG. 3) in a locking manner to prevent complete removal of the paperboard tray 115 tram within the paperboard over-sleeve 110. The locking engagement of the second sleeve tab 120*b* with the first tray tab 135 is shown in FIG. 17, which is a cross-sectional illustration along 13-13 of the paperboard box 100 in the opened state.

The inventive child-resistant paperboard box 100 advantageously includes a sleeve divider tab 125 and requires the paperboard tray 115 to be slid from one side to the other so as to "unlock" the paperboard box 100 before the paperboard tray 115 can be pulled from the paperboard over-sleeve 110.

Thus, in accordance with the disclosed embodiments of the invention, in order to open the paperboard box 100, the paperboard box 100 is held in both hands with the top of the box facing up and a first side facing proximately, i.e., toward the body of the person seeking to open the paperboard box. While applying equal pressure to all tabs, they are push down and the paperboard tray 115 is pulled/slid toward the body of the person seeking to open the paperboard box 100.

Once the paperboard tray 115 is completely pulled and touches the wall of the paperboard over-sleeve, fingers are placed on opposite sides of the end of the tray-(one on each side) to pull/slide the paperboard tray 115 from out the paperboard over-sleeve until it catches, i.e., the tabs engage. The box is now open.

In order to close the inventive paperboard box 100, with the paperboard tray 115 fully extended from the paperboard over-sleeve 110, fingers are placed at opposite sides of the ends the paperboard tray 115. The paperboard tray 115 is now slid/pushed distally, i.e., away from the body of the person seeking to close the paperboard box 100 toward the opposite side of the paperboard over-sleeve 110.

Once the paperboard tray 115 is completely pushed to the opposite wall of the paperboard over-sleeve 110, the paperboard tray 115 can now be slid/pushed back into the sleeve until it "clicks" in place to thereby lock the paperboard box 110.

Thus, while there have been shown, described and pointed out fundamental novel features of the invention as applied to a preferred embodiment thereof, it will be understood that various omissions and substitutions and changes in the form and details of the methods described and the devices illustrated, and in their operation, may be made by those skilled in the art without departing from the spirit of the invention. For example, it is expressly intended that all combinations of those elements or structure shown which perform substantially the same function in substantially the same way to achieve the same results are within the scope of the invention. Moreover, it should be recognized that elements or structure shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A child-resistant package, comprising:

a paperboard box including:

a paperboard over-sleeve including a flap having a first sleeve tab and second a sleeve tab;

a sleeve divider tab longitudinally arranged within the paperboard over-sleeve and forming a channel; and a paperboard tray including a first tray tab, the paperboard tray being removably inserted within the paperboard over-sleeve and arranged adjacent to the sleeve divider tab in a locked state within the channel, the first sleeve tab being resiliently biased to prevent the paperboard tray from moving perpendicularly with respect to the sleeve divider tab arranged longitudinally within the paperboard over-sleeve in the locked state.

2. The child-resistant package as claimed in claim 1, wherein the second sleeve tab engages with the first tray tab of the paperboard tray in a locking manner when the paperboard tray is pulled along a longitudinal axis of the paperboard box to an open position.

3. The child-resistant package as claimed in claim 1, wherein the sleeve divider tab is circumferentially rotatable about an axis which extends along a longitudinal axis of the paperboard box to permit transverse or lateral movement of the paperboard tray to open the paperboard tray.

4. The child-resistant package as claimed in claim 1, wherein the paperboard tray is rectangular and includes an upper opening, the first tray tab engaging in a locking manner with the second sleeve tab of the paperboard tray when the paperboard tray is pulled along a longitudinal axis of the paperboard box to an open position.

5. The child-resistant package as claimed in claim 1, wherein the paperboard tray includes closed upper and lower surfaces, and includes an opening at one end having the first tray tab and the second tray, the first tray tab engaging in a locking manner with the second sleeve tab of the paperboard tray when the paperboard tray is pulled along a longitudinal axis of the paperboard box to an open position.

6. The child-resistant package as claimed in claim 1, wherein the paperboard over-sleeve includes u-shaped cutouts, a triangular shaped cutout, an internal sleeve locking tab and an upper sleeve tab.

7. The child-resistant package as claimed in claim 6, wherein the internal tray locking tab engages with the first tray tab of the paperboard tray to prevent the paperboard box from being opened when attempting to slide the paperboard tray from within the paperboard over-sleeve.

8. The child-resistant package as claimed in claim 1, wherein the paperboard over-sleeve includes a folding indentation section which abuts the paperboard tray when in a locked state within the channel.

9. The child-resistant package as claimed in claim 1, wherein the paperboard box is formed from paper having a grade in the range of 18 to 22 points.

10. The child-resistant package as claimed in claim 1, wherein the paperboard box has a grade of 20 points.

11. A child-resistant package, comprising:

a paperboard box including:

a paperboard over-sleeve including a flap having a first sleeve tab and second a sleeve tab;

a sleeve divider tab longitudinally arranged within the paperboard over-sleeve and forming a channel; and a paperboard tray including a first tray tab, the paperboard tray being removably inserted within the paperboard over-sleeve and arranged adjacent to the sleeve divider tab in a locked state within the channel, the first sleeve tab being resiliently biased to prevent the paperboard tray from moving transversely in the locked state;

wherein the second sleeve tab engages with the first tray tab of the paperboard tray in a locking manner when the paperboard tray is pulled along a longitudinal axis of the paperboard box to an open position.

12. A child-resistant package, comprising:

a paperboard box including:

a paperboard over-sleeve including a flap having a first sleeve tab and second a sleeve tab;

a sleeve divider tab longitudinally arranged within the paperboard over-sleeve and forming a channel; and a paperboard tray including a first tray tab, the paperboard tray being removably inserted within the paperboard over-sleeve and arranged adjacent to the sleeve divider tab in a locked state within the channel, the first sleeve tab being resiliently biased to prevent the paperboard tray from moving transversely in the locked state;

wherein the sleeve divider tab is circumferentially rotatable about an axis which extends along a longitudinal axis of the paperboard box to permit transverse or lateral movement of the paperboard tray to open the paperboard tray.

* * * * *